US006862913B2

(12) United States Patent
Lempenauer et al.

(10) Patent No.: US 6,862,913 B2
(45) Date of Patent: Mar. 8, 2005

(54) DEVICE AND METHOD FOR MECHANICALLY JOINING SHEET METAL

(75) Inventors: Klaus Lempenauer, Ulm (DE); Detlef Nowotni, Grabenstetten (DE); Volkmar Schuler, Ulm (DE)

(73) Assignee: DaimlerChrysler AG, Stuttgart (DE)

( * ) Notice: Subject to any disclaimer, the term of this patent is extended or adjusted under 35 U.S.C. 154(b) by 151 days.

(21) Appl. No.: 10/316,543

(22) Filed: Dec. 11, 2002

(65) Prior Publication Data

US 2003/0115927 A1 Jun. 26, 2003

(30) Foreign Application Priority Data

Dec. 13, 2001 (DE) ..... 101 61 250

(51) Int. Cl.[7] ..... B23Q 17/00; B21D 26/02
(52) U.S. Cl. ..... 72/430; 72/56; 72/710; 29/715
(58) Field of Search ..... 72/430, 56, 710; 29/715

(56) References Cited

U.S. PATENT DOCUMENTS 3,201,967 A * 8/1965 Balamuth et al. ..... 72/359
3,341,935 A * 9/1967 Balamuth ..... 72/56
3,643,483 A * 2/1972 Minchenko et al. ..... 72/56
3,945,231 A * 3/1976 Imazu et al. ..... 72/45
4,854,149 A * 8/1989 Porucznik et al. ..... 72/710
6,029,487 A * 2/2000 Genin et al. ..... 72/58
6,199,271 B1 * 3/2001 Hahn et al. ..... 29/715

FOREIGN PATENT DOCUMENTS

| | | |
|---|---|---|
| DE | 19905527 | 8/2000 |
| DE | 10060035 | 8/2001 |
| EP | 0890397 | 1/1999 |

* cited by examiner

*Primary Examiner*—David Jones
(74) *Attorney, Agent, or Firm*—Davidson, Davidson & Kappel, LLC

(57) ABSTRACT

The present invention is directed to a method and a device for clinching metal sheets disposed one over the other in planar fashion. A joining tool, composed of a punch and a die having an anvil, is used to jointly displace metal sheets, profiles, or multi-sheet connections, out of the sheet-metal plane, under the action of forming energy introduced by ultrasound, compressing and integrally connecting the same.

16 Claims, 1 Drawing Sheet

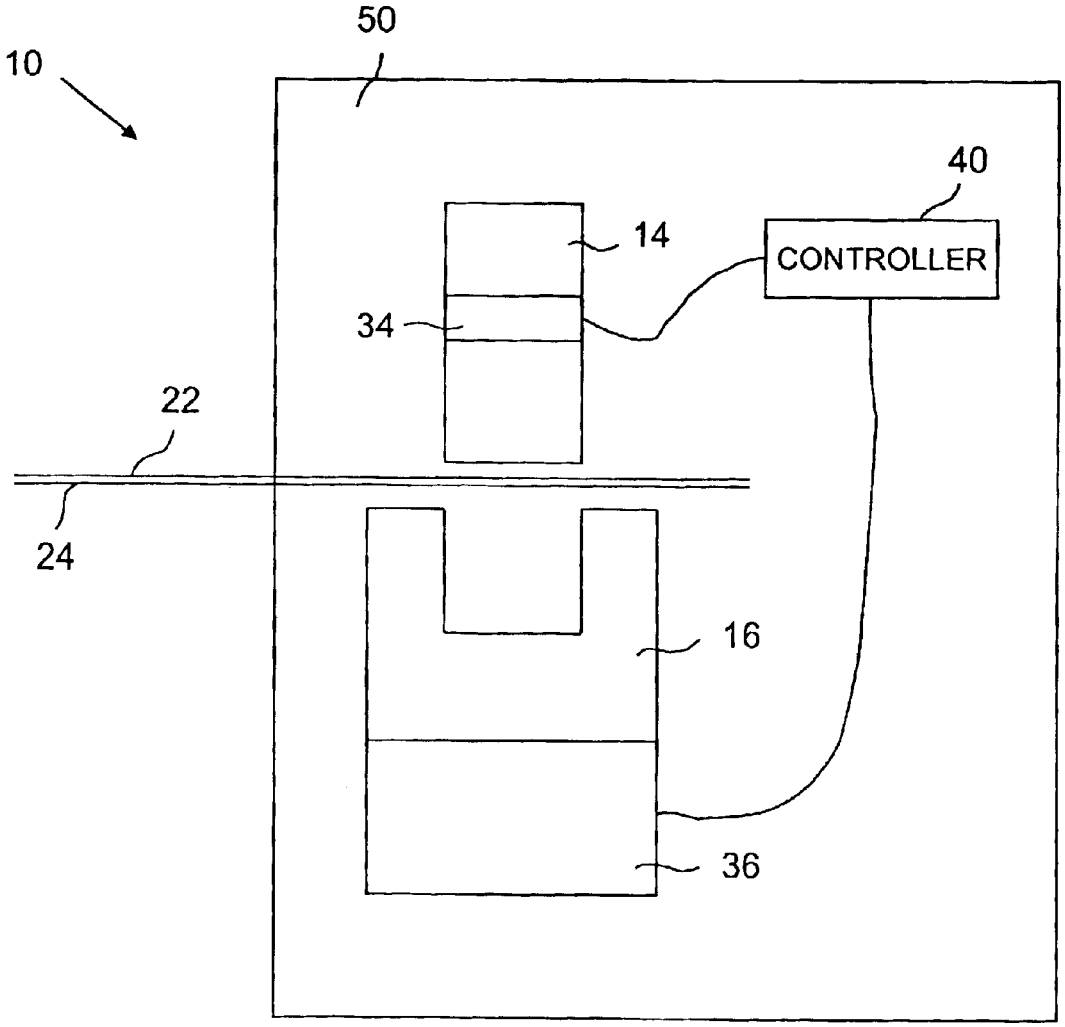
10
50
40
CONTROLLER
14
34
22
24
16
36

DEVICE AND METHOD FOR MECHANICALLY JOINING SHEET METAL

Priority to German Patent Application No. 101 61 250.8-14, filed Dec. 13, 2001 and hereby incorporated by reference herein, is claimed.

BACKGROUND INFORMATION

The present invention is directed to a method and a device for clinching metal sheets disposed one over the other in planar fashion, where a joining tool, composed of a punch and a die having an anvil, partially displaces metal sheets, profiles, or multi-sheet connections, out of the sheet-metal plane, under the action of forming energy, compressing the same.

In known clinching processes, during a working stroke, a punch penetrates into the metal sheets to be joined, a one-piece or segmented die producing the form on the opposite side.

The forming of the indentation by the tools is not only accompanied by force-locking, but also by the known form-locking effect, the so-called undercutting, between the joint partners, the process usually being carried out until a targeted reduction in the bottom thickness is reached. In the process, in the punch-side sheet, the original material thickness is substantially thinned to the so-called throat thickness in the area of the clinching punch. In principle, to increase the strength of the connection, a high undercut and a substantial throat thickness are essential. The strength of the connection is further enhanced by cold-pressure welding in the zones of greatest reshaping between the joint partners.

A joining device is known from European Patent Application No. 0 890 397 A1. The percussive or pulsating driving of the punch into the punch-side part to be joined produces so great a punch acceleration that, as the punch penetrates into the part to be joined, it draws in less material from the part to be joined into the die than in previous, standard joining operations employing the hydraulic application of force. When working with the pulsed application of force, the area of the part to be joined underneath the end face of the punch is stretched more vigorously.

For the application of force, various drives can be accommodated in the percussion mechanism provided for penetration of the punch. Useful in this context are pneumatic drives, such as those in a pneumatic chisel or pneumatic hammer, electric drives, for example having a rotary crank drive, unbalance motors, or electromagnetic, electropneumatic, or servohydraulic drives. These enable the frequency, the impact strength and impact speed to be varied within a certain range.

German Patent Application No. DE 100 60 035 A1 discloses a device for mechanically joining metal sheets, profiles, and/or multi-sheet connections, where the punch of a joining tool composed of an upper part and die, penetrates into a part to be joined by the action of a plurality of rapidly successive impacts, or by pulsating at an excitation frequency.

The surface area of the punch is designed to inhibit slip, at least in the area of its front, unattached end section. The result is an increased coefficient of friction between the surface of the punch tip and the part to be joined.

The stretching of the material located underneath the end face of the punch tip is further reduced by an additional slip-inhibiting design of the end face of the punch surface. This inhibition of slip can be accomplished by roughening the punch surfaces mentioned above. It is customary for the surface area of the unattached end section and the end face of the punch to be provided with circumferential grooves or ribs. In another form of inhibiting slip of the punch surfaces, the surfaces can be provided with a slip-inhibiting coating.

The increase in the coefficient of friction of the punch surfaces leads to more material being drawn in from the area of the part to be joined bordering on the joint when the punch penetrates into the part to be joined, this material being available for the undercut-forming upsetting or back-taper process, and the greater stretching associated therewith in the throat region of the joint leads to a greater strengthening of this throat region and to improved material-strength characteristics of the joint. Via the degree of forming and the undercut, the strength of the connection can be further increased here as well by improving the cold-pressure welding.

BRIEF SUMMARY OF THE INVENTION

An object of the present invention is to further improve the quality of the connection in the clinching process.

The present invention provides a method for clinching metal sheets disposed one over the other in planar fashion, where a joining tool, composed of a punch and a die having an anvil, jointly displaces metal sheets, profiles, or multi-sheet connections, out of the sheet-metal plane, under the action of forming energy, compressing the same. The forming energy is applied by a high-frequency vibration of the punch (sonotrode) in the ultrasonic range, and the high-frequency vibration is introduced in the joining operation during a sink-in/penetration phase, longitudinally in the direction of the sheet thickness, and subsequently during a cold-upsetting process, torsional vibration is introduced with an alternating directional sense and/or translational vibration in the direction of the sheet-metal plane.

The method of the present invention includes a clinching method, according to which the compressive forces, which are to be applied in a work step in conventional clinching, are reduced.

In accordance with the present invention, the forming energy is applied by a high-frequency vibration of the punch, as a sonotrode, in the ultrasonic range. Optimally tuned to one another, a small mass and comparatively low percussive energy are assigned to the vibrating system at a high impact frequency.

In the same way, the forming energy may also be applied by way of a high-frequency vibration of the entire die or only at certain die locations and, preferably at the punch and die.

The present invention also provides a device for clinching metal sheets disposed one over the other in planar fashion, profiles, or multi-sheet connections, composed of a frame having a joining tool mounted therein, including a punch and a die having an anvil, wherein the joining tool is provided with ultrasonic devices which apply a pulsating force to the parts to be joined, the ultrasonic devices being situated in the punch and in the die.

In such a device, an ultrasonic unit is placed then, for example, at opposite locations, or also a plurality of ultrasonic units at the material layers to be joined. The ultrasonic units cooperate in such a way that they input their energy, preferably simultaneously, from opposite regions from the punch and the die, into the join region of the material layers to be joined. For this, the ultrasonic units in question are tuned to one another with respect to their output, frequency, amplitude, and phase-relation parameters.

During the joining operation, the punch and/or die are guided linearly towards one another by a controller.

The application of force may be selectively modulated by varying the frequency, amplitude, and phase relation of the high-frequency vibration of the punch.

The entire forming device is isolated from vibrations. Preferably, only the joining tool is set into vibration to a degree that is dependent on the particular case. In this context, together, the punch and die essentially form a coupled vibratory system. To suppress the natural frequencies of the entire machine, the frame may be designed to have a controllable vibration response. This is achieved through the use of additional devices with the aid of supplementary masses or variable stiffening components.

Due to the high excitation frequency of the impacts of the joining tool, high peak forces result during a short application time. Accordingly, the pressure force produced by the controller may be correspondingly reduced during the joining operation. In some instances, the movement executed by the punch and die relatively to one another is only manifested as a slight down force, and, in some instances, merely as a following-type movement.

Preferably, the action of force by the ultrasound is transmitted via the punch initially longitudinally during a sink-in or punch-sinking phase, i.e., in the direction of the sheet-metal thickness, by rapid impacts of the tool.

Subsequently, during a cold-upsetting process, the ultrasound is introduced via torsional vibration, with an alternating directional sense and/or translational vibration, preferably in the direction of the sheet-metal plane, into the part to be joined. In addition to the cold-pressure welding, this facilitates the elimination of surface contamination on a localized basis, to enlarge the cold-welded regions. As a result, besides the force-locking and form-locking connection, the parts to be joined are integrally interlocked in the area of the web thickness (residual base thickness). The result is an increased shear strength or direct tensile strength.

Consequently, during the sink-in/penetration phase, the force- and/or form-locking connection is produced, and preferably during the cold-upsetting process, an integral connection is produced.

The frictional heat produced by the ultrasound facilitates the forming operation due to the temperature-dependent decrease in the deformation resistance of the parts to be joined.

The sheets may be coated or surface-treated, have different thicknesses, be made of different materials, or have an intermediate layer.

During the clinching process using a cutting component, the joint element is formed under the localized action of a combined shearing and clinching process and a cold-upsetting process. The sheet material displaced out of the sheet plane is upset, so that, by broadening or spreading, a force- and form-locking connection is formed.

During the clinching process without the use of a cutting component, in a combined sink-in and penetration process, in which the sink-in operation borders on the joint region, as well as during a cold-upsetting process in which the clinched material volume is upset, a force-locking, form-locking, and integrally interlocking connection is produced by extrusion. In this context, a different plasticity of the die-side and punch-side part to be joined is given.

One particular benefit of the present invention is the integral connection of the parts to be joined, which supplements the force- and form-locking connection in the area of the web thickness (residual base thickness). The increased shear strength or direct tensile strength derived therefrom expands the possible applications of sheet-metal joining in terms of forming technology, or, because of the improved material properties of the joined parts, even opens up new applications for mechanical joint connections.

In addition, it is possible to manufacture power formers having larger working ranges and clearance spaces, thereby reducing the amount of forming power required.

BRIEF DESCRIPTION OF THE DRAWING

FIG. 1 shows a schematic embodiment of the present device.

DETAILED DESCRIPTION

FIG. 1 shows a device 10 for clinching metal sheets 22, 24 disposed one over the other in planar fashion. Device 10 has a joining tool 12 which has a punch 14 and a die 16 having an anvil, all supported movably with respect to a stationary frame 50. The joining tool is provided with ultrasonic devices such as sonotrodes 34, 36 in the punch 14 and the die 16, respectively, which apply a pulsating force to the parts 22, 24 to be joined. A controller 40 can control the movement of the punch 14 and die 16.

In a first step, the metal sheets are jointly displaced out of their plane using a high-frequency vibration of at least one of punch 14 and die 16 in a direction of a thickness of the sheet, i.e. up or down in FIG. 1. In a second subsequent step, a torsional (rotating) vibration or a translational vibration in the direction the sheet metal plane is introduced by at least one of the punch 14 and die 16 during a cold-upsetting process.

Displacing the metal sheets out of the sheet metal plane as defined herein includes jointly displacing the metal sheets, profiles, or multi-sheet connections, out of the sheet-metal plane. U.S. Pat. No. 6,199,271 is hereby incorporated by reference herein.

What is claimed is:

1. A method for clinching metal sheets disposed one over the other in a sheet-metal plane using a joining tool having a punch and a die with an anvil comprising the steps of:

jointly displacing the metal sheets out of the sheet-metal plane using, a high-frequency ultrasonic vibration of the punch, the high-frequency ultrasonic vibration occurring while the punch penetrates the sheets longitudinally in a direction of a thickness of the sheets, and subsequently during a cold-upsetting process introducing a torsional vibration with an alternating directional sense in a direction of the sheet-metal plane.

2. The clinching method as recited in claim 1 wherein, during the displacing step, a controller guides at least one of the punch and the die linearly towards one another.

3. The clinching method as recited in claim 1 further comprising varying a frequency, amplitude, and phase relation of the high-frequency vibration of the punch during the displacing step to optimize an application of force.

4. The method as recited in claim 3 wherein a force- and/or form-locking connection is produced when the punch penetrates the sheets, and a further connection is produced during the cold-upsetting process.

5. The method as recited in claim 1 wherein a sonotrode provides the high-frequency ultrasonic vibration.

6. A device for clinching metal sheets disposed one over the other in planar fashion, comprising:

a frame;

a joining tool mounted in the frame, the joining tool including a punch and a die having an anvil, the joining tool including a first ultrasonic device in the punch for applying a first pulsating force in a first direction perpendicular to a plane of the metal sheets to be joined and a second ultrasonic device in the die for applying a second pulsating force to the metal sheets in the first direction, at least one of the punch and the die being movable in a second direction in the plane of the metal sheets and perpendicular to the first direction.

7. The device as recited in claim 6 wherein the first ultrasonic device is a sonotrode.

8. The device as recited in claim 6 wherein the second direction is a translational direction.

9. The device as recited in claim 6 wherein the second direction is a rotational direction.

10. The method as recited in claim 1 wherein the punch introduces the torsional vibration.

11. A method for clinching metal sheets disposed one over the other in a sheet-metal plane using a joining tool having a punch and a die with an anvil comprising the steps of:

jointly displacing the metal sheets out of the sheet-metal plane using a high-frequency ultrasonic vibration of the punch, the high-frequency ultrasonic vibration occurring while the punch penetrates the sheets longitudinally in a direction of a thickness of the sheets, and subsequently during a cold-upsetting process introducing a translational vibration in a direction of the sheet-metal plane.

12. The clinching method as recited in claim 11 wherein, during the displacing step, a controller guides at least one of the punch and the die towards one another.

13. The clinching method as recited in claim 11 further comprising varying a frequency, amplitude, and phase relation of the high-frequency vibration of the punch during the displacing step to optimize an application of force.

14. The method as recited in claim 13 wherein a force- and/or form-locking connection is produced when the punch penetrates the sheets and a further connection is produced during the cold-upsetting process.

15. The method as recited in claim 11 wherein a sonotrode provides the high-frequency ultrasonic vibration.

16. The method as recited in claim 11 wherein the punch introduces the translational vibration.

* * * * *